United States Patent [19]

Mimura et al.

[11] Patent Number: 4,516,611

[45] Date of Patent: May 14, 1985

[54] WEFT YARN STORAGE UNIT FOR JET LOOMS

[75] Inventors: Nobuharu Mimura, Aichi; Kazunori Yoshida, Nagoya; Susumu Kawabata; Junzo Hasegawa, both of Aichi, all of Japan

[73] Assignee: Kabushiki Kaisha Toyota Chuo Kenkyusho, Aichi, Japan

[21] Appl. No.: 444,062

[22] Filed: Nov. 23, 1982

[30] Foreign Application Priority Data

Nov. 25, 1981 [JP] Japan ..... 56-188667

[51] Int. Cl.[3] ..... D03D 47/36

[52] U.S. Cl. ..... 139/452; 242/47.01

[58] Field of Search ..... 139/452, 435; 242/47.01, 47.12; 66/132 R

[56] References Cited

U.S. PATENT DOCUMENTS

| | | | |
|---|---|---|---|
| 4,002,190 | 1/1977 | Sevcik et al. | 139/452 |
| 4,208,017 | 6/1980 | Ichikawa et al. | 242/47.01 |
| 4,320,786 | 3/1982 | Popp | 139/452 |
| 4,381,807 | 5/1983 | Umezawa et al. | 139/452 |
| 4,418,729 | 12/1983 | Chiba et al. | 139/452 |

FOREIGN PATENT DOCUMENTS

| | | | |
|---|---|---|---|
| 2088910 | 6/1982 | United Kingdom | 139/452 |
| 230741 | 10/1972 | U.S.S.R. | 139/452 |

*Primary Examiner*—James Kee Chi

*Attorney, Agent, or Firm*—Berman, Aisenberg & Platt

[57] ABSTRACT

A weft yarn storage unit disposed between a yarn supply package and a weft insertion device for storing a weft yarn to be inserted in the warp shed, comprises a differential yarn feeding device for feeding the weft yarn from the yarn supply package, and a yarn storage means for winding the fed weft yarn therearound by co-operating with the differential yarn feeding device, storing the wound weft yarn therearound and unwinding the stored weft yarn therefrom by co-operating with the weft insertion device, the yarn storage means being continuously rotating in a direction opposite to the direction in which the weft yarn is unwound at a predetermined circumferential speed in response to an insertion speed of the weft yarn. This weft yarn storage unit allows high-speed weft insertion while preventing the yarn breakage by reducing ballooning of the weft yarn when the weft yarn is released off the yarn storage drum.

21 Claims, 18 Drawing Figures

WEFT YARN STORAGE UNIT FOR JET LOOMS

BACKGROUND OF THE INVENTION

1. Field of the Invention

The present invention relates to a weft yarn storage unit for use in a shuttleless loom known as a jet loom, rapier and the like.

2. Description of the Prior Art

Shuttleless looms known as jet looms measure and store a length of weft yarn to be inserted each time it is taken through the warp shed for intermittent weft insertion on a jet of fluid such as air or liquid.

One conventional type of weft yarn storage unit for use in jet looms measures and stores weft yarn by winding the latter around the circumference of a yarn storage drum for a predetermined number of convolutions or turns. The stored length of weft yarn is drawn off axially of the yarn storage drum by a jet of fluid ejected from a weft insertion device in order to be placed in the warp shed.

The weft yarn, which is drawn at a high speed by the jet of fluid from the weft insertion device in the axial direction of the yarn storage drum (stationary, i.e. not rotatable) is withdrawn around the outer peripheral surface of the yarn storage drum with its rotation and is subjected to centrifugal forces due to the ballooning phenomenon. The centrifugal forces place the weft yarn under tension, resulting in an obstacle to high-speed weft insertion operation. The weft yarn as thus tensioned needs to be driven under a high pressure of jet of fluid, which tends to cause yarn breakage.

Another proposed yarn storage unit includes a yarn storage drum rotatable about its own axis for drawing weft yarn off a yarn supply package under rotational forces to measure and store a length of weft yarn. With this type of yarn storage unit, resistance to weft insertion operation (i.e. back tension) is slightly smaller than that in other conventional yarn storage units in which the yarn storage drum is fixed in position. However, since the yarn storage drum rotates to unreel the weft yarn from the yarn supply package, the circumferential speed of the yarn storage drum is equal to the speed at which the weft yarn is drawn from the yarn supply package. With the circumferential speed of the yarn storage drum being low, the weft yarn as it is unwound from the yarn storage drum still suffers from ballooning, and it is impossible to reduce back tension to a sufficient degree.

There has heretofore been proposed another device for measuring weft yarn with a feed roller rotatable in synchronism with the rotational frequency of the loom and for storing the measured length of weft yarn in the shape of a U as it floats on an ejected jet of air. The floating weft yarn however is unstable in attitude, and undergoes snarling or has twisted weft yarn lengths, resulting in a tendency to produce defective woven fabrics. For larger cloth widths, this yarn storage device increases back tension imposed on the weft yarn, and hence fails to store the weft yarn stably, effect high-speed yarn ejection and prevent yarn breakage when the warp shed is wider.

SUMMARY OF THE INVENTION

The primary object of the present invention is to provide a weft yarn storage unit which can reduce ballooning when the weft yarn is released off the yarn storage drum.

Another object of the present invention is to provide a weft yarn storage unit which can reduce back tension through giving kinetic energy to the weft yarn, thus preventing yarn breakage.

A further object of the present invention is to provide a weft yarn storage unit which can allow high-speed insertion of weft yarn without suffering from yarn breakage.

A still further object of the present invention is to provide a weft yarn storage unit in which the weft yarn is less likely to be broken when a jet of air is ejected from the weft insertion device at a high speed, so that the weft yarn of smaller strength can be used.

A still further object of the present invention is to provide a weft yarn storage unit which can take many modifications in construction.

A weft yarn storage unit according to the present invention disposed between a yarn supply package and a weft insertion device for storing a weft yarn to be inserted in the warp shed, comprises a differential yarn feeding device for feeding the weft yarn from the yarn supply package, and a yarn storage means for winding the fed weft yarn therearound by co-operating with the differential yarn feeding device, storing the wound weft yarn therearound and unwinding the stored weft yarn therefrom by co-operating with the weft insertion device, the yarn storage means being continuously rotating in a direction opposite to the direction in which the weft yarn is unwound at a predetermined circumferential speed in response to an insertion speed of the weft yarn.

Namely, in the weft yarn storage unit according to the present invention having the construction described above, the circumferential speed of the unwound point of the stored weft yarn unwound from the yarn storage means is reduced by the rotation of the yarn storage means in the opposite direction and at the predetermined circumferential speed in response to an insertion speed of the weft yarn, so that the centrifugal force applied to the unwound weft yarn from the yarn storage means is reduced by reducing the circumferential speed of the unwound point of the stored weft yarn.

Accordingly, as the ballooning of the unwound weft yarn and the back tension applied to the unwound weft yarn are reduced by reducing the centrifugal force applied to the unwound weft yarn, the breakage of the weft yarn is prevented and the high-speed weft insertion is allowed.

A first preferred aspect of the weft yarn storage unit according to the present invention comprises the differential yarn feeding device comprising a rotatable member continuously rotated at a predetermined circumferential speed in order to feed the weft yarn from the yarn supply package, and the yarn storage means comprising a rotatable member, having a portion for winding the fed weft yarn, continuously rotated at a predetermined circumferential speed in response to the insertion speed of the weft yarn, the fed weft yarn being wound and stored around the portion of the yarn storage means by the difference of circumferential speeds of movable members in the differential yarn feeding device and the yarn storage means.

In the first preferred aspect of the weft yarn storage unit having the construction described above, the circumferential speed of the unwound point of the stored weft yarn from the rotatable member of the yarn storage means is reduced by the rotation of the movable member of the yarn storage means in the opposite direction and at the predetermined high circumferential speed, so that the centrifugal force applied to the unwound weft yarn from the movable member of the yarn storage means is reduced by reducing the circumferential speed of the unwound point of the stored weft yarn.

A second preferred aspect of the weft yarn storage unit according to the present invention has the following characteristics in the first preferred aspect. The rotatable member of the yarn storage means comprises a yarn stoage drum rotatable at a circumferential speed which is 45% or more of the insertion speed of the weft yarn. The fed weft yarn is wound and stored around the side circumferential wall of the yarn storage drum.

In the second preferred aspect of the weft yarn storage unit having the construction described above, the circumferential speed of the unwound point of the stored weft yarn from the rotatable member of the yarn storage means is effectively reduced by the rotation of the yarn storage drum in the opposite direction and at the high circumferential speed which is 45% or more of insertion speed of the weft yarn.

If the circumferential speed of the yarn storage drum is equal to the insertion speed of the weft yarn, the circumferential speed of the unwound point of the stored weft yarn is zero i.e. the unwound point of the stored weft yarn maintains at a predetermined rotational phase of the yarn storage drum. As a result, the centrifugal force applied to the weft yarn due to the rotation thereof is zero, and the ballooning and back tension are completely prevented.

Generally, the circumferential speed of the yarn storage drum is decided to the average speed of the insertion speed of the weft yarn.

A third preferred aspect of the weft yarn storage unit according to the present invention has the following characteristics in the another preferred aspect. The rotatable member of the differential yarn feeding device comprises a yarn feeder arm rotatable at a circumferential speed smaller than that of the yarn storage drum in the same direction as that of rotation thereof.

In the third preferred aspect, the weft yarn is fed, wound, and stored around the yarn storage drum by the difference of the circumferential speeds of the yarn feeder arm and the yarn storage drum.

A fourth preferred aspect of the weft yarn storage unit accoring to the present invention has the following characteristics in the third aspect. The yarn storage drum and the yarn feeder arm are driven through gear trains by one drive source.

In the fourth preferred aspect, as the drive source is only one, the weft yarn storage unit is simple, compact and at low cost.

A fifth preferred aspect of the weft yarn storage unit according to the present invention has the following characteristics in the third aspect. The yarn storage drum is driven by one drive source and the yarn feeder arm is driven by the other drive source.

In the fifth preferred aspect, as the yarn storage drum and the yarn feeder arm are respectively and independently driven by the different drive sources, the yarn storage drum and the yarn feeder arm may be respectively driven on the best and ideal conditions.

A sixth preferred aspect of the weft yarn storage unit according to the present invention has the following characteristics in the third aspect. The differential yarn feeding device comprises a length measuring device for measuring and feeding out a length of the yarn in synchronism with a rotation of a loom.

In the sixth aspect, the weft yarn having a predetermined length measured by the length measuring device may be inserted in the warp shed.

DETAILED DESCRIPTION OF THE PREFERRED EMBODIMENTS

The present invention will be described with reference to the drawings which show embodiments of the invention.

Figure 1:
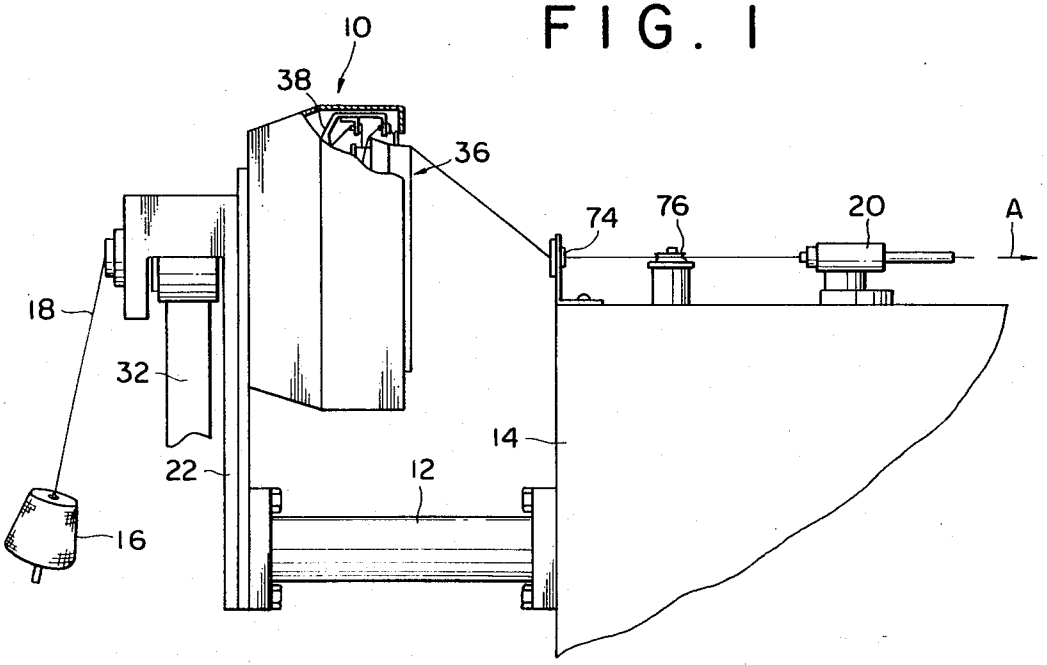
FIG. 1 is a front elevational view of a weft yarn storage unit for a jet loom according to a first embodiment of the present invention.

As shown in FIG. 1, a weft yarn storage unit 10 according to an embodiment of the present invention is affixed by a bracket 12 to a loom frame 14 for drawing weft yarn 18 from a yarn supply package 16 to measure and store the same. The weft yarn as stored is intermittently withdrawn from the weft yarn storage unit 10 by a jet of air from a weft insertion nozzle 20 for being inserted through the warp shed in the direction of arrow A.

A bearing support 22 has one end secured by the bracket 12 to the loom frame 14 and also has on its other distal end a pair of bearings 24, 26 (FIG. 2) disposed in coaxial relation and supporting a central shaft 28. The central shaft 28 supports a pulley 30 fixed thereto and positional between the bearings 24, 26. A belt 32 (FIG. 1) extends around the pulley 30 and the output shaft of a drive unit such as a motor (not shown) so that the central shaft 28 will be rotated by rotative power transmitted from the drive unit. The belt 32 has on its inner face a plurality of ridges and grooves which are held in driving mesh with grooves and ridges defined on the outer periphery of the pulley 30. Thus, the pulley 30 rotates at an rotational frequency in synchronism with that of rotation of the drive unit.

A gear 34 is mounted on the central shaft 28 remotely from the pulley 30. A yarn storage drum 36 is fastened to the gear 34 in coaxial relation therewith and with the central shaft 28. The yarn storage drum 36 includes a parallel cylindrical portion 36A closer to the bearings 24, 26 for winding thereon the weft yarn 18 continuously at a constant speed. The yarn storage drum 36 also includes a step portion 36B and contiguous conical portions 36C, 36D closer to the weft insertion nozzle 20, the conical portions 36C, 36D being tapered or having their outside diameters progressively reduced toward the weft insertion nozzle 20. The conical portion 36C is steeper than the conical portion 36D for preventing weft yarn convolutions as wound thereon from being superimosed on each other. The conical portion 36D serves to store weft yarn convolutions as wound thereon. The conical portion 36D has an average diameter which is substantially the same as the diameter of the parallel cylindrical portion 36A.

A yarn feeder arm 38 extends in overhanding relation to the outer periphery of the yarn storage drum 36. The yarn feeder arm 38 includes a proximal cylindrical portion 38A partly embedded in the central shaft 28 and extends radially thereof, the cylindrical portion 38A being held in communication with a weft passage hole 40 defined coaxially in the central shaft 28. The weft yarn 18 is inserted through the weft passage hole 40 and guided through the cylindrical portion 38A toward a distal end portion of the yarn feeder arm 38.

A pair of yarn guides 42, 44 are mounted on the distal end of the yarn feeder arm 38 and a portion closer than the distal end to the cylindrical portion 38A, respectively. The yarn guide 44 serves to receive and guide the weft yarn from the cylindrical portion 38A to go along a bent path. The yarn guide 42 serves to receive the weft yarn as supplied from the yarn guide 44 and wound on the parallel cylindrical portion 36A and guide the yarn to be fed along a bent path onto the conical portion 36C of the yarn storage drum 36.

The yarn storage drum 36 is driven by the central shaft 28 through a planetary gear to rotate in the same direction of rotation of the central shaft 28 and at a speed larger than the speed of rotation of the latter. The planetary gear mechanism includes a gear 46 extending around the central shaft 28 and integral with the bearing support 22, a gear 50 held in mesh with the gear 46 and rotatably supported on a lever 48 projecting radially outwardly from the central shaft 28, a gear 52 supported on the lever 48 in coaxial relation to the gear 52, a small-diameter direction changer gear 54 rotatably supported on the lever 48 and held in mesh with the gear 52, and the gear 34 meshing with the small-diameter gear 54. The speed of rotation of the central shaft 28 is increased by the planetary gear mechanism. The direction of rotation of the central shaft 28 is reversed by the direction changer gear 54. The yarn storage drum 36 thus rotates at an rotational frequency greater than that of the central shaft 28 and hence the yarn feeder arm 38 and in the same direction of rotation of that of the central shaft 28 and the yarn feeder arm 38.

Figure 3:
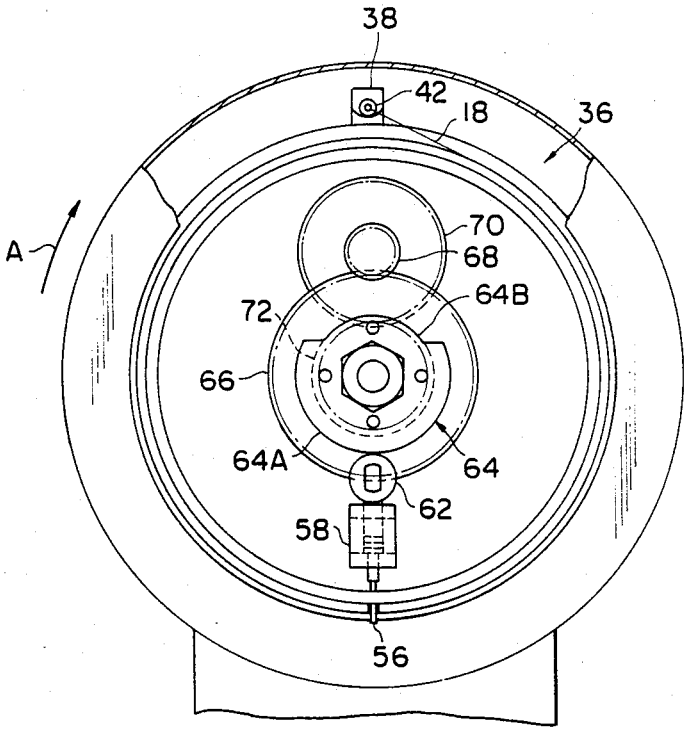
FIG. 3 is a side elevational view of the portion shown in FIG. 2.

When the yarn wound around the yarn storage drum 36 is unwound toward the weft insertion nozzle 20, unwound turns of the weft yarn are displaced on the circumference of the yarn storage drum 36 to thereby cause balloning. The direction of rotation of the yarn storage drum 36 is opposite (in the direction of the arrow A in FIG. 3) to that of unwinding of the weft yarn for thereby eliminating such ballooning.

The yarn storage drum 36 has a locking pin 56 projecting through the outer periphery of the conical portion 36D for preventing the weft yarn from being withdrawn off the conical portion 36D toward the weft insertion nozzle 20. The locking pin 56 has a proximal end portion disposed in a hollow portion of the yarn storage drum 36 and supported on a guide 58 affixed to the yarn storage drum 36. The locking pin 56 is movable radially of the yarn storage drum 36 so that the distal end of the locking pin 56 can move into and out of the yarn storage drum 36. A compression coil spring 60 acts between the locking pin 56 and the guide 58 to normally urge the distal end of the locking pin 56 in a direction to move into the yarn storage drum 36.

The locking pin 56 has on its end closer to the central shaft 28 a roller 62 in contact with a cam 64 rotatably mounted on the central shaft 28. The cam 64 includes a projection 64A and a recess 64B. When the projection 64A of the cam 64 is held against the roller 62, the locking pin 56 projects through the circumference of the yarn storage drum 36 for storing the weft yarn thereon. When the roller 62 is positioned in the recess 64B, the locking pin 56 is retracted into the yarn storage drum 36 under the resiliency of the compression coil spring 60, whereupon the weft yarn stored on the yarn storage drum 36 can be drawn toward the weft insertion nozzle 20.

A gear 66 is affixed to the cam 64 coaxially with the central shaft 28 and meshes with a smaller-diameter gear 68 rotatably supported on the yarn storage drum 36 in parallel relation to the central shaft 28. A larger-diameter gear 70 is secured to the smaller-diameter gear 68 and held in mesh with a smaller-diameter gear 72 fixed coaxially to the central shaft 28. The gears 68, 70 serve to rotate the gear 66 for controlling movement of the locking pin 56 in response to relative rotation between the yarn storage drum 36 and the central shaft 28 when the yarn storage drum 36 rotates. The number of teeth of the gears 66, 68, 70 and 72 is selected such that the roller 62 will be disposed in the recess 64B of the cam 64 when the weft yarn is to be inserted in the warp shed by the weft insertion nozzle 20.

Figure 2:
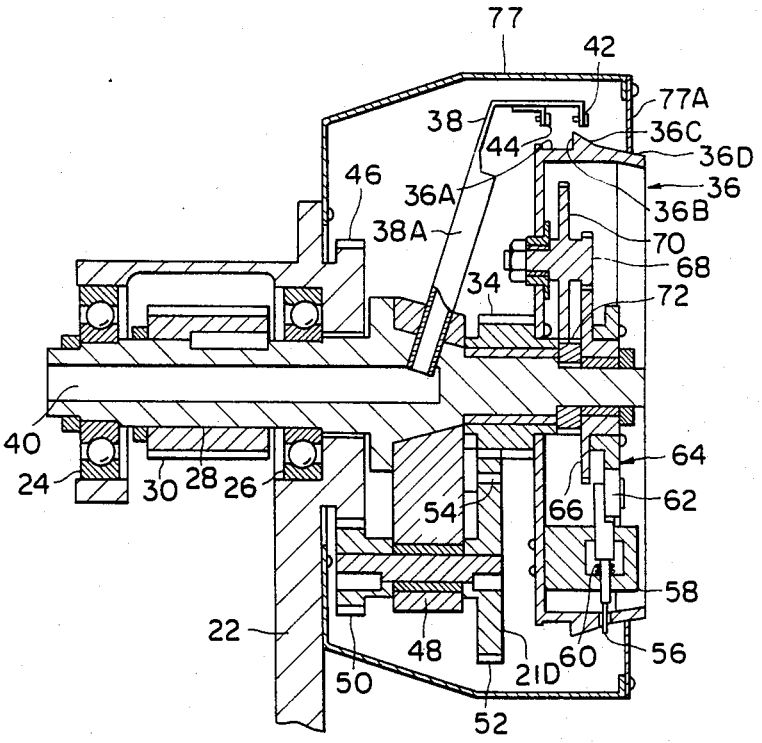
FIG. 2 is a vertical cross-sectional view showing the positional relationship between a yarn storage drum and a yarn feeder arm.

As illustrated in FIG. 1, a yarn guide 74 and a gripper 76 are disposed between the yarn storage drum 36 and the weft insertion nozzle 20. The yarn guide 74 serves to feed the weft yarn as drawn from the yarn storage drum 36 toward the weft insertion nozzle 20 through the gripper 76. The gripper 76 releases the weft yarn 18 when it is to be inserted through the warp shed by the weft insertion nozzle 20, and grips the weft yarn 18 when the weft insertion is completed. In FIG. 2, the yarn storage drum 36 and the yarn feeder arm 38 are covered by a cover 77 fastened to the bearing support 22 and having a front end portion 77A extending closely to the conical portion 36D of the yarn storage drum 36 for preventing the occurrence of ballooning.

Operation of the weft yarn storage unit will now be described.

When the belt 32 as driven by the drive unit rotates the central shaft 28 through the pulley 30, the yarn feeder arm 38 rotates with the central shaft 28. The yarn storage drum 36 is caused by the differential gear mechanism to rotate at a rotational frequency greater than that of the central shaft in the same direction of rotation as that of the yarn feeder arm 38.

The weft yarn 18 as it is drawn through the yarn feeder arm 38 is supplied through the yarn guide 44 onto the parallel cylindrical portion 36A of the yarn storage drum 36 to form several yarn convolutions. The weft yarn 18 then passes through the yarn guide 42 and is wound around the conical portions 36C, 36D. At this time, the weft insertion nozzle 20 is inactive, and the cam 64 in the yarn storage drum 36 is held against the projection 64A of the cam 64, so that the locking pin 56 has its distal end projecting through the yarn storage drum 36 to prevent the weft yarn convolutions from be drawn toward the weft insertion nozzle 20.

When a predetermined amount of weft yarn 18 is stored on the yarn storage drum 36, the recess 64B of the cam 64 is brought into engagement with the roller 62, whereupon the locking pin 56 is retracted into the yarn storage drum 36 to allow the stored weft yarn 18 to be drawn off. At the same time, the gripper 76 releases the weft yarn 18, and the weft insertion nozzle 20 ejects air from a source of pressurized air (not shown) in the direction of the arrow A (FIG. 1). The weft yarn 18 is continuously withdrawn from the conical portion 36D of the yarn storage drum 36 by the jet of air so as to be inserted through the warp shed (not illustrated).

While the weft yarn is being drawn from the yarn storage drum 36, the latter continuously rotates in a direction opposite to the direction in which the yarn 18 is unwound, the weft yarn is subjected to small centrifugal forces and hence undergoes small tension, resulting in a reduced degree of back tension imposed on the yarn. The weft yarn 18 is less likely to be broken when a jet of air is ejected from the weft insertion nozzle 20 at a higher speed. Thus, weft yarn of smaller strength can be used on the weft yarn storage unit of the invention. Where equal speeds of weft ejection are desired, the weft insertion nozzle 20 may eject jets of air under smaller pressure.

When the weft insertion is completed, the cam projection 64A in the yarn storage drum 36 is held against the roller 62 again, pushing the locking pin 56 radially outwardly through the yarn storage drum 36 to prevent the weft yarn from being withdrawn off the yarn storage drum 36, whereupon the weft yarn starts being stored again on the drum 36. Since the yarn feeder arm 38 rotates contiuously at a speed lower than the speed of rotation of the yarn storage drum 36, a length of weft yarn which is long enough to be inserted through the warp shed can contiuously be wound around the yarn storage drum 36 during an interval between consecutive weft insertion cycles.

Figure 4:
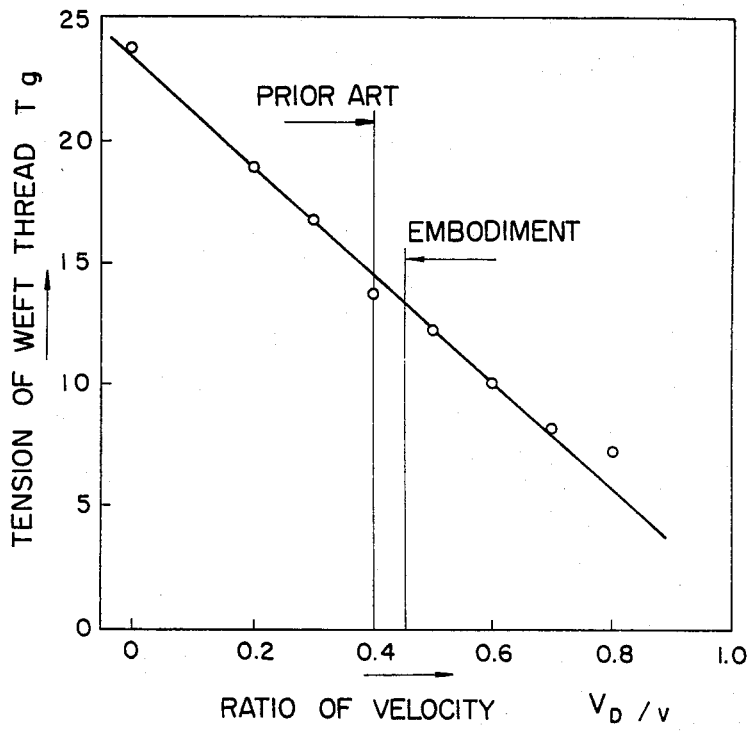
FIG. 4 is a graph showing the relationship between the ratio of the periphral speed of the yarn storage drum to the speed of weft yarn ejection by a weft insertion nozzle and weft yarn tension.

The relationship between the circumferential speed of the yarn storage drum 36 (parallel cylindrical portion 36A) and the speed of weft ejection by the weft insertion nozzle 20 will now be described. FIG. 4 shows the relationship between tension T of the weft yarn and a ratio $V_D/v$ of the circumferential speed $V_D$ (which ranges from 0 to 32 m/s) of the yarn storage drum 36 to the speed v of weft ejection by the weft insertion nozzle 20. The weft yarn tension T is measured by a tensile force meter placed between the weft insertion nozzle 20 and the yarn storage drum 36 (having a diameter of 240 mm). The weft yarn used has Ne=16's. The graph of FIG. 4 shows that as the speed ratio increases, the weft yarn tension decreases. According to the embodiment of the invention, the speed ratio is 45% or more (preferably 50% or higher), and the weft yarn tension is 13 g or less. With a conventional weft yarn storage unit in which the yarn storage drum is rotatable, the yarn feeder arm is held at rest, and the circumferential speed of rotation of the yarn storage drum is equal to the speed at which the yarn is drawn off the yarn supply package, with the result that the speed ratio $V_D/v$ is 0.4 or less and the yarn tension is 15 g or higher.

Timing of loom operation will be described with reference to FIG. 5A. According to the embodiment of the present invention, the yarn feeder arm 38 is caused by the differential gear mechanism to rotate at a lower speed than and in the same direction as the yarn storage drum 36 regardless of the fact that the yarn storage drum rotates at a circumferential speed which is 45% or more of the speed of weft ejection by the weft insertion nozzle 20. This enables the yarn feeder arm 38 to be continuously rotated without the danger of excessive storage of the weft yarn onto the yarn storage drum 36. FIG. 5B illustrates data which would be obtained if a yarn storage drum in a conventional weft yarn storage unit with no differential yarn supply device rotated at a circumferential speed of 45% or higher of the speed of weft ejection by the weft insertion nozzle. Since the yarn storage drum with no differential yarn supply device has the same circumferential speed of rotation as the speed at which the yarn is drawn off the yarn supply package, the weft yarn is excessively stored onto the yarn storage drum. The conventioal weft yarn storage unit would thus require the yarn storage drum to be intermittently rotated with yarn storage operation stopped for a time interval of $t_a$, an arrangement which will be a cause of yarn breakage.

Figure 5A:
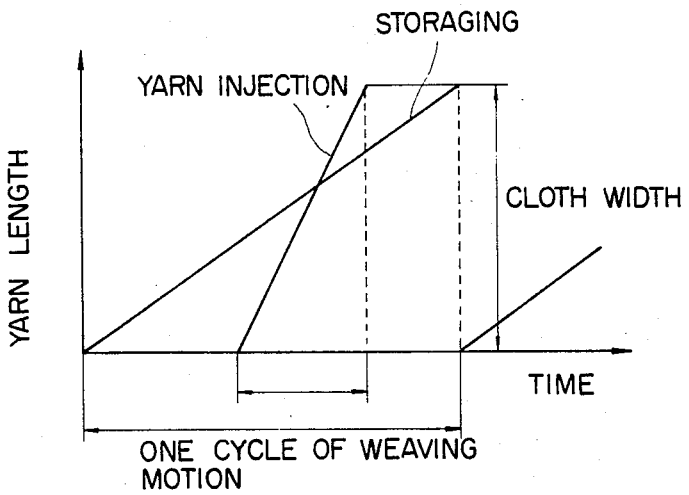
FIG. 5A is a graph showing loom operation timing according to the first embodiment by way of the relationship between time and yarn length.
Figure 5B:
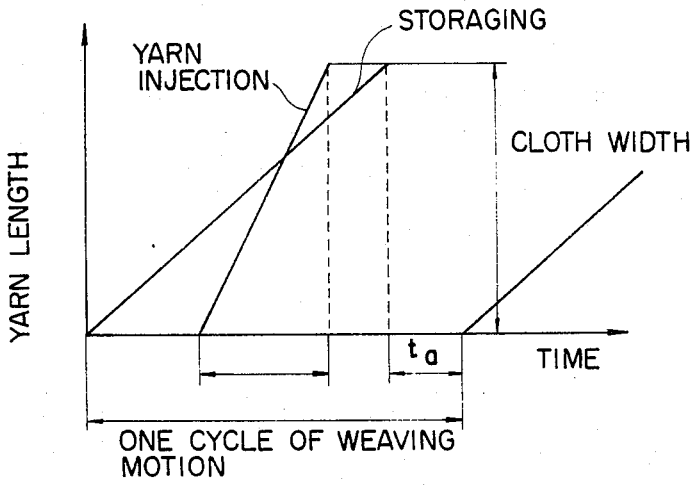
FIG. 5B is a graph showing loom operation timing according to an improved yarn storage unit of conventional design.

The interval of time during which the weft yarn is ejected in FIG. 5A and 5B is about one-third (which is equivalent to an angle of rotation of 120 degrees) of one revolution of the loom, the rest of the time being available for warp shed formation and beating motion during which the weft yarn is stored.

Figure 6:
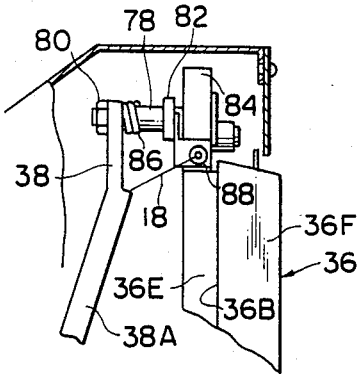
FIG. 6 is an enlarged elevational view of a weft yarn storage unit according to a second embodiment.
Figure 7:
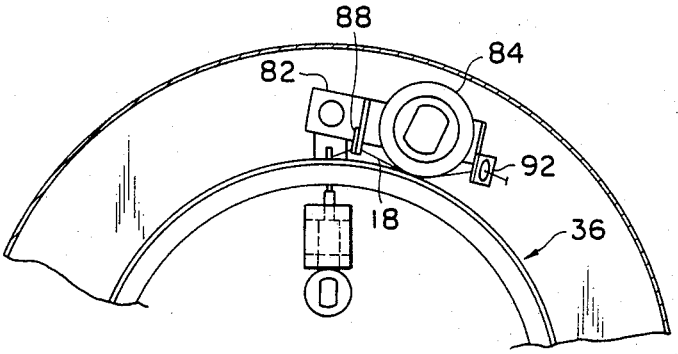
FIG. 7 is a right-hand side elevational view, with a portion of a cover being omitted from illustration, of the portion shown in FIG. 6.
Figure 8:
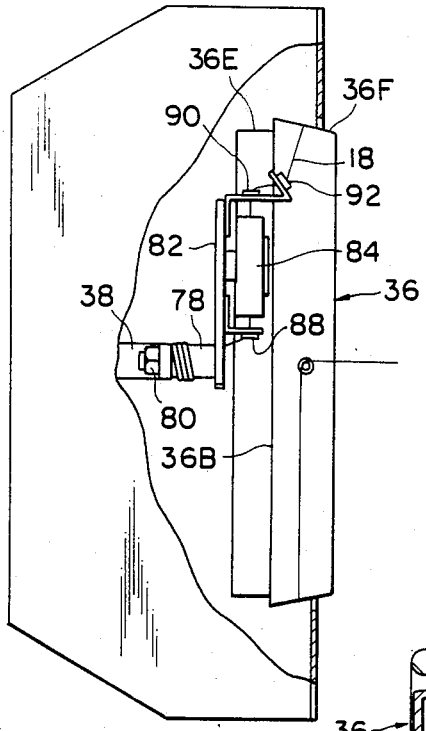
FIG. 8 is a plan view, with parts broken away, of the portion shown in FIG. 6.

FIGS. 6 through 8 illustrate a weft yarn storage unit according to a second embodiment of the present invention. The weft yarn storage unit includes a yarn storage drum 36 having a parallel portion 36E closer to a yarn feeder arm 38 and a step portion 36B and a conical portion 36F which are closer to the weft insertion nozzle.

The yarn feeder arm 38 has on its distal end a rocker shaft 78 attached thereto by a nut 80 and supporting on its distal end a support plate 82 on which is rotatably mounted a roller 84 having an axis parallel to the axis of the yarn storage drum 36 and radially aligned with the parallel portion 36E of the drum 36. A torsion coil spring 86 acts between the rocker shaft 78 and the yarn feeder arm 38 for normally urging the rocker shaft 78 to press the roller 84 against the parallel portion 36E of the yarn storage drum 36.

The support plate 82 supports thereon a yarn guide 88 disposed between the roller 84 and the ayrn feeder arm 38, and yarn guides 90, 92 on a distal end of the support plate 82 remote from the yarn guide 88 across the roller 84. The yarn guide 88 serves to guide the weft yarn as drawn from the yarn feeder arm 38 to pass along a path normal to the axis of the roller 84 and between the roller 84 and the yarn feeder arm 38. The yarn guide 90 receives the weft yarn as it emerges from between the roller 84 and the yarn storage drum 36 and guides the weft yarn to go along a path substantially parallel to the axis of the yarn feeder arm 38. The yarn guide 92 guides the weft yarn from the yarn guide 90 to be wound around the conical portion 36F of the yarn storage drum 36. The weft yarn as it is drawn from the yarn guide 92 is wound around the conical portion 36F, from which the weft yarn is fed along toward the weft insertion nozzle past the locking pin 56.

The other structure of the weft yarn storage unit shown in FIGS. 6 through 8 is the same as that of the weft yarn storage unit according to the first embodiment. The yarn storage drum 36 of the second embodiment therefore rotates at a circumferential speed higher than the speed at which the weft yarn is drawn off the yarn supply package to thereby enable high-speed weft yarn ejection. At the same time, the yarn feeder arm 38 rotates slower than the yarn storage drum 36 in the same direction as that of the drum 36, with the result that yarn breakage and twisting can be prevented during yarn storage. With the second embodiment, the weft yarn is reliably prevented from getting entangled on storage and can be measured reliably for its length as the weft yarn 18 is wound around the yarn storage drum 36 while being sandwiched between the roller 84 and the yarn storage drum 36.

Figure 9:
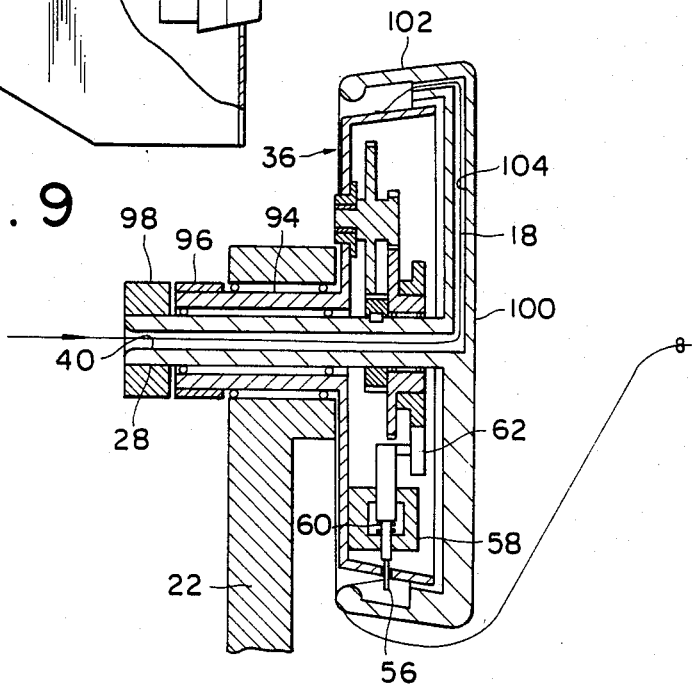
FIG. 9 is a cross-sectional view of a weft yarn storage unit according to a third embodiment.

FIG. 9 shows a weft yarn storage unit according to a third embodiment. The weft yarn storage unit of FIG. 9 includes a bearing support 22 on which is rotatably mounted a hollow shaft 94 through which a central shaft 28 extends coaxially.

A yarn storage drum 36 is affixed to the hollow shaft 94 for corotation. The yarn storage drum 36 has a tapered circumference having a diameter progressively larger toward the weft insertion nozzle 20 or to the right in FIG. 9. The hollow shaft 94 has a pulley 96 on its end remote from the yarn storage drum 36. A belt travels around the pulley 96 and a drive unit such as a motor (not shown) for driving the pulley 96. The central shaft 28 has one end projecting beyond the pulley 96 and supporting a pulley 98 fixed thereto which is drivable by a drive unit (not illustrated). The other end of the central shaft 28 extends through the yarn storage drum 36 and includes a disc 100 which serves as a yarn feeder arm. The disc 100 has on its outer periphery a sleeve 102 extending over the tapered outer peripheral portion of the yarn storage drum 36. The disc 100 and the sleeve 102 have a hole 104 of circular cross section which is held in communication with a weft passage hole 40 in the central shaft 28 for guiding weft yarn from a yarn supply package onto the outer periphery of the yarn storage drum 36.

The yarn storage drum 36 has a locking pin 56 as with the first embodiment for storing weft yarn convolutions on the drum 36, the locking pin 56 being retractable into the drum 36 for allowing the weft yarn to be withdrawn for weft insertion. The weft yarn as it is unwound from the yarn storage drum 36 is guided around the sleeve 102 toward the weft insertion nozzle.

Since the weft yarn storage unit according to the third embodiment has no speed changing device, it is necessary that the pulleys 96, 98 be supplied with rotative powers which have already been subjected to speed changing operation or which are generated by different drive units for rotating the yarn storage drum 36 and the disc 100. The yarn storage drum 36 and the disc 100 rotate at speeds as described above with reference to the preceding embodiments. Therefore, the weft yarn can be ejected at a high speed, and the weft yarn storage unit can continuously be rotated to protect the weft yarn against breakage during storage.

The third embodiment is best suited for a weft yarn storage unit having a weft feeder arm is located more closely than the yarn storage drum 36 to the weft insertion nozzle 20. The yarn storage drum 36 is tapered in a direction opposite to that in which the yarn storage drum in the first embodiment is tapered, so that weft yarn convolutions will be prevented from being superimposed on each other. The weft yarn can be wound around the yarn storage drum 36 from a position thereon closer to the weft insertion nozzle by guiding the weft yarn axially through the central shaft 28 and then radially outwardly thereof. This arrangement allows rotative power to be transmitted to both the central shaft 28 and the hollow shaft 94. Thus, the weft yarn storage unit of the third embodiment is free from the difficulty with the weft yarn storage unit of the first embodiment in that the yarn storage drum 36 cannot be supplied with rotative power since when the weft yarn which is wound on the yarn storage drum 36 through the yarn feeder arm fixed to the drum 36 at a position closer to the yarn supply package (or to the left in FIG. 9), the yarn feeder arm and the weft yarn as it is wound by the yarn feeder arm onto the yarn storage drum 36 are rotated around the central shaft.

Figure 10:
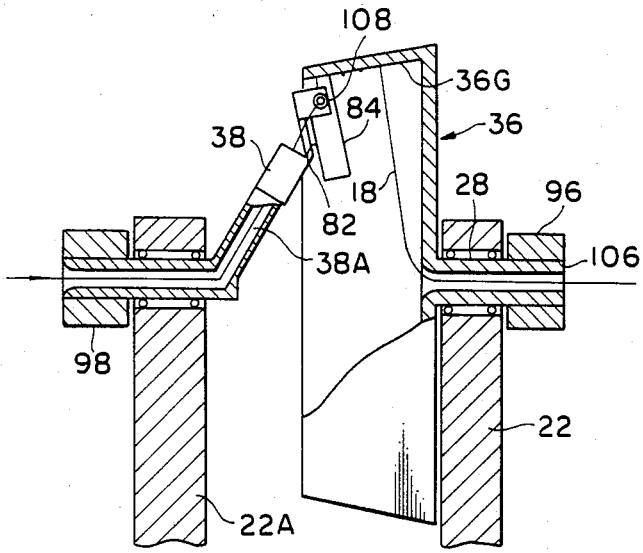
FIG. 10 is a cross-sectional view of a weft yarn storage unit according to a fourth embodiment.
Figure 11:
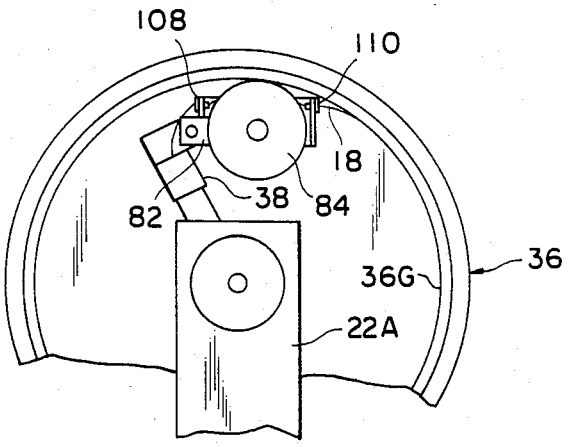
FIG. 11 is a left-hand side elevational view of the unit shown in FIG. 10.

FIGS. 10 and 11 illustrate a weft yarn storage unit according to a fourth embodiment, in which weft yarn is stored on an inner peripheral surface of a yarn storage drum.

More specifically, as shown in FIG. 10, the yarn storage drum 36 includes a inner peripheral conical portion 36G having an inside diameter progressively larger toward the weft insertion nozzle or to the right in FIG. 10. The yarn storage drum 36 has a hollow shaft 106 projecting toward the weft insertion nozzle and rotatably supported on a bearing support 22. The hollow shaft 106 includes an end extending through the bearing support 22 and supporting a drivable pulley 96.

Another bearing support 22A is fixed to and spaced from the bearing support 22 by a distance toward the yarn supply package or to the left in FIG. 10. A yarn feeder arm 38 is rotatably mounted on the bearing support 22A in coaxial relation to the yarn storage drum 36. The yarn feeder arm 38 is drivable by a pulley 98 secured to one end thereof. The yarn feeder arm 38 also supports on the other end thereof a support plate 82 and a roller 84 which are the same as those of the second embodiment (shown in FIGS. 6 through 8). The roller 84 has an axis extending substantially parallel to the inclined surface of the conical portion 36G of the yarn storage drum 36. Weft yarn as it is supplied from the yarn feeder arm 38 is sandwiched between the roller 84 and the inner peripheral surface of the conical portion 36G. The weft yarn is guided by yarn guides 108, 110 before and after it is sandwiched between the roller 84 and the conical portion 36G.

Yarn withdrawal is controlled by a gripper (which is the same as the gripper 76 of FIG. 1) disposed between the yarn storage unit and the weft insertion nozzle. Thus, no cam and pin are necessary which are placed in the yarn storage drum according to the preceding embodiments, and a simpler construction results.

The rotational frequency of the yarn storage drum 36 and the yarn feeder arm 38 is selected as in the preceding embodiments. The weft yarn 18 as drawn from the yarn feeder arm 38 is sandwiched between the roller 84 and the conical portion 36G and is withdrawn toward the yarn guide 110 due to the difference between the speeds of rotation of the yarn feeder arm 38 and the yarn storage drum 36. The weft yarn 18 which is withdrawn from the yarn guide 110 is pressed against the conical portion 36G under centrifugal forces so as to be wound thereon. Weft yarn covolutions as thus wound are successively slid under centrifugal forces toward the larger-diameter end of the drum 36 or toward the weft insertion nozzle. Therefore, the weft yarn convolutions are prevented from being stacked one on the other, and the weft yarn can be ejected at a high speed without yarn breakage.

With the arrangment of the fourth embodiment, the weft yarn is wound on the inner peripheral surface of the yarn storage drum under centrifugal forces, and hence the weft yarn is subjected to no undue external forces, with the consequence that the weft yarn is prevented from yarn breakage more reliably.

Figure 12:
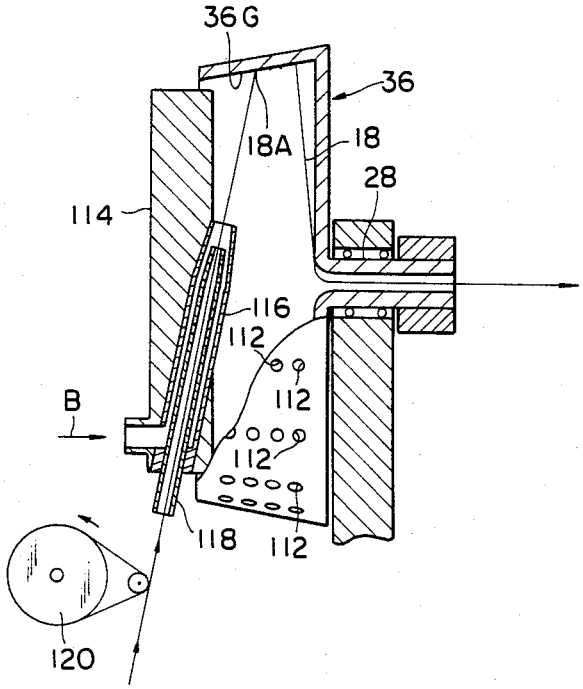
FIG. 12 is a cross-sectional view of a weft yarn storage unit according to a fifth embodiment.

FIG. 12 is illustrative of a weft yarn storage unit according to a fifth embodiment, in which weft yarn is stored on an inner peripheral surface of a yarn storage drum as with the fourth embodiment.

The yarn storage drum 36 has a hollow conical portion 36G similar to the conical portion in the weft yarn storage drum of the fourth embodiment. However, the yarn storage drum of FIG. 12 has a plurality of small holes 112 extending radially to provide communication between the interior and exterior of the yarn storage drum 36.

A nozzle base 114 is positioned at an opening in the yarn storage drum 36 which faces the yarn supply package, the nozzle base 114 being fixed to a loom base (not shown). An air ejection yarn feeder nozzle 116 which serves as a yarn feeder arm is mounted on the nozzle base 114 and is held in communication with a source of pressurized air (not shown) for supplying air under pressure in the direction of the arrow B.

The air ejection yarn feeder nozzle 116 is of a double-walled construction including an axial weft yarn guide 118 for guiding weft yarn 18 from the yarn supply package to be blown against the inner peripheral surface of the yarn storage drum 36 under the pressure of air ejected from the nozzle 116. The air ejection yarn feeder nozzle 116 has a distal end disposed in the vicinity of the axis of the yarn storage drum 36.

Between the air ejection yarn feeder nozzle 116 and the yarn supply package (not shown), there is provided a feed roller 120 doubling as a length measuring device operable in synchronism with the rotational frequency of the loom for delivering a required length of weft yarn into the weft yarn guide 118. Since the air ejection yarn feeder nozzle 116 places a length of weft yarn 18 which has been measured in advance onto the inner peripheral surface of the yarn storage drum 36, the parts such as the locking pin 56, the gripper 76 and the like can be disposed with which are includes in the foregoing embodiments.

In operation, the yarn storage drum 36 is driven in the same menner as that in the preceding embodiments so as to rotate at a circumferential speed higher than the speed of withdrawal of the weft yarn from the yarn supply package, and the weft yarn as measured by the feed roller 120 is wound by the air ejection yarn feeder nozzle 116 onto the conical portion 36G of the yarn storage drum 36. The weft yarn can be ejected at a high speed without yarn breakage as with the above embodiments. With the distal end of the air ejection yarn feeder nozzle 116 being positioned in the vicinity of the axis of the yarn storage drum 36, there is no danger for the weft yarn 18 to slip on the inner peripheral surface of the yarn storage drum 36. The weft yarn 18 includes a portion 18A which is in contact with the conical portion 36G of the yarn storage drum 36, the portion 18A being rotatable relatively around the axis of the yarn storage drum 36 to take up the difference between the circumferential speed of the yarn storage drum 36 and the speed of weft ejection from the air ejection yarn feeder nozzle 116. Thus, the air ejection yarn feeder nozzle 116 serves as a differential yarn feeder for winding the weft yarn on the yarn storage drum at the speed of yarn withdrawal from the yarn supply package.

The weft yarn storage unit according to the fifth embodiment has no differential gear mechanism as according to the first embodiment, and its yarn feeder arm does not need to be driven by a separated drive unit as according to the fourth embodiment. Consequently, the weft yarn storage unit shown in FIG. 12 is much simpler in construction.

Figure 13:
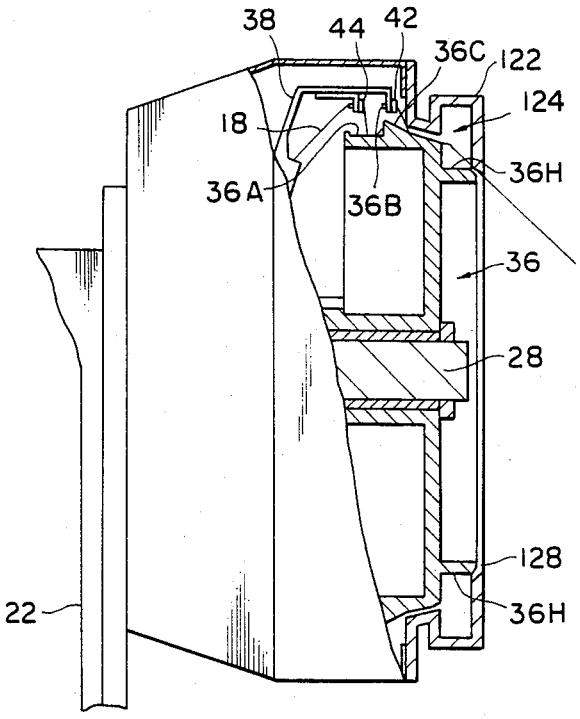
FIG. 13 is a cross-sectional view of a weft yarn storage unit according to a sixth embodiment.
Figure 14:
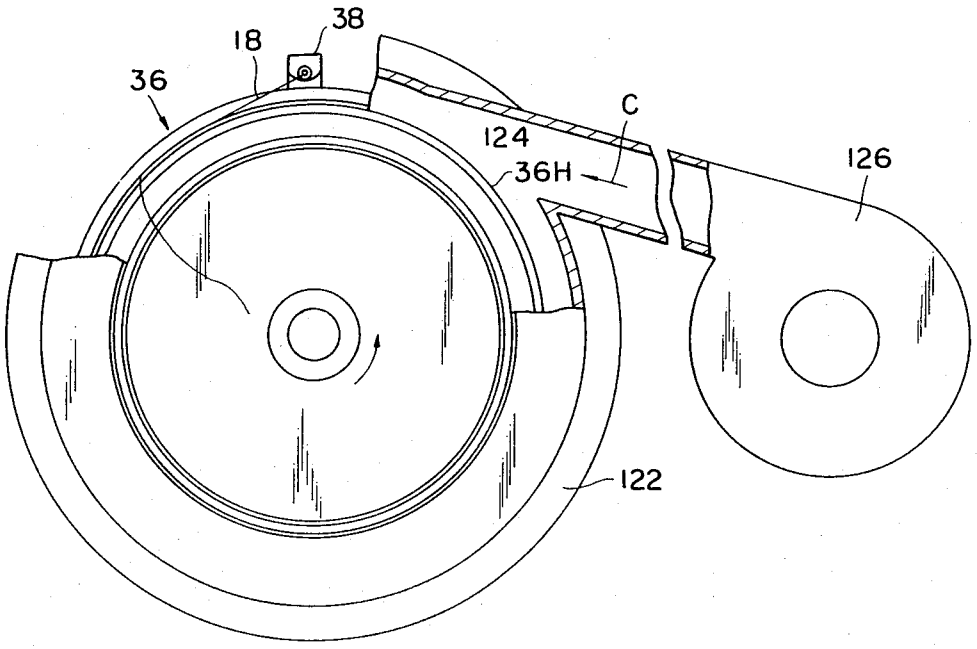
FIG. 14 is a right-hand side elevational view of the unit shown in FIG. 13.

A weft yarn storage unit according to a sixth embodiment of the invention is shown in FIGS. 13 and 14. The weft yarn storage unit of the sixth embodiment utilizes, instead of the locking pin 56 in the first embodiment, a swirling stream of air to control withdrawal of weft yarn 18 from the yarn storage drum 36.

A yarn storage drum 36, which is similar to the drum of the first embodiment, includes a parallel portion 36H smaller in diameter than a conical portion 36D and located closer to the weft insertion nozzle. A hood 122 is attached to a cover 77 and cooperates with the parallel portion 36H in defining an annular air chamber 124 of rectangular cross section extending around the axis of the yarn storage drum. An air blower 126 (FIG. 14) is connected to the air chamber 124 for directing an air stream toward the air chamber 124 from the air blower 126 in the direction of the arrow C or in the direction of rotation of the yarn storage drum 36. The air stream swirls in the air chamber 124 at a speed greater than the circumferential speed of rotation of the yarn storage drum 36. The relationship between the speeds of rotation of the yarn storage drum 36 and the yarn feeder arm 38 is the same as that described in the preceding embodiments.

The weft yarn storage unit according to the sixth embodiment effects high-speed ejection of the weft yarn and prevents yarn breakage as with the foregoing embodiments. In addition, the air stream introduced in the air chamber 124 prevents the weft yarn stored on the outer periphery of the drum from being withdrawn. The weft yarn can only be unwound from the yarn storage drum 36 when insertion nozzle ejects the weft yarn. This arrangement eliminates the locking pin 56, the drive mechanism such as the cam, and timing adjustment therefor, which are necessitated by the weft yarn storage unit according to the first embodiment. The weft yarn is drawn off the weft yarn storage drum toward the weft insertion nozzle (not shown) through a gap 128 defined between a distal edge of the hood 122 and a distal edge of the parallel portion 36H of the yarn storage drum.

Figure 15:
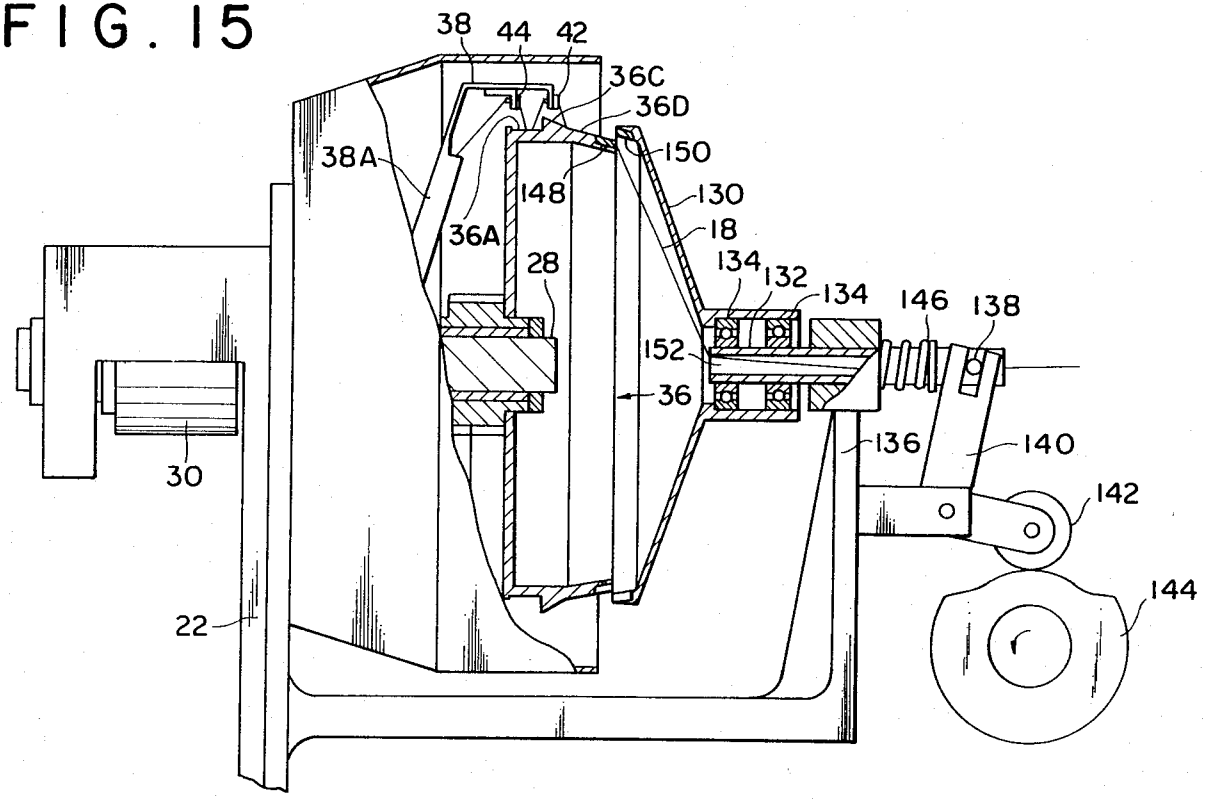
FIG. 15 is a cross-sectional view of a weft yarn storage unit according to a seventh embodiment.

FIG. 15 shows a weft yarn storage unit according to a seventh embodiment of the present invention. The weft yarn storage unit shown in FIG. 15 includes a weft yarn gripper cone 130 positioned more closely to the weft insertion nozzle than a yarn storage drum 36 which is substantially of the same construction as that of the yarn storage drum of first embodiment. The weft yarn gripper cone 130 is movable into and out of contact with the conical portion 36D of the yarn storage drum 36 for controlling yarn withdrawal from the yarn storage drum 36.

More specifically, the weft yarn gripper cone 130 is rotatably supported by bearings 134 on an axially movable shaft 132 supported coaxially with the yarn storage drum 36 on a support bracket 136 which is attached to a bearing support 22 affixed to a loom frame (not shown). The shaft 132 is axially movable to bring the weft yarn gripper cone 130 into and out of contact with the yarn storage drum 36.

The axially movable shaft 132 has an end projecting beyond the support bracket 136 and having a pin 138 which is inserted through a forked end of a cam follower 140 pivotally mounted on the support bracket 136. The cam follower 140 has a follower roller 142 rotatably mounted on its other end and bearing against a cam 144. The follower roller 142 of the cam follower 140 is normally held against the outer periphery of the cam 144 under the resiliency of a compression coil spring 146 disposed between the axially movable shaft 132 and the support bracket 136. The cam 144 is rotatable in synchronism with the timing of operation of the loom. More specifically, when the weft yarn is to be placed in the warp shed, the recess of the cam 144 engages the follower cam 142 to displace the weft yarn gripper cone 130 away from the yarn storage drum 36 for allowing weft yarn withdrawal form the yarn storage drum 36. For storing the weft yarn on the yarn storage drum 36, the projection of the cam 144 pushes the follower roller 142 upwardly to bring the weft yarn gripper cone 130 into abutment against an outer periphery of the yarn storage drum 36 to permit the weft yarn to be stored circumferentially around the yarn storage drum 36.

Permanent magnets 148, 150 are embedded respectively in an outer peripheral end of the yarn storage drum 36 and an inner peripheral end of the weft yarn gripper cone 130. The weft yarn gripper cone 130 rotates with the yarn storage drum 36 while the latter is rotating at a high speed under magnetically attractive forces acting between the permanent magnets 148, 150. The weft yarn gripper cone 130 may be rotated by driving power which is transmitted thereto through a special mechanism rather than the permanent magnets.

The weft yarn as it is withdrawn from the yarn storage drum 36 passes through a bore 152 defined axially in the axially movable shaft 132 toward the weft insertion nozzle (not illustrated).

The yarn storage drum 36 and the yarn feeder arm 38 according to the seventh embodiment rotate at relative speeds which are the same as those in the first embodiment. Thus, the yarn feeder arm 38 can wind the weft yarn 18 onto the yarn storage drum 36 without breaking the weft yarn. For yarn storage, the follower roller 142 is lifted by the cam 144 to cause the weft yarn gripper cone 130 to contact the outer periphery of the yarn storage drum 36 for pinching the weft yarn 18 for storage thereof on the drum 36. When the weft yarn 18 is to be inserted in the warp shed, the weft yarn gripper cone 130 is spaced form the outer periphery of the yarn storage drum 36, and simultaneously the weft insertion nozzle (not shown) ejects air to draw the weft yarn 18 from the yarn storage drum 36 into the warp shed.

Therefore, the yarn storage drum 36 according to the seventh embodiment enables high-speed weft ejection while preventing yarn breakage. In particular, weft yarn withdrawal from the yarn storage drum is controlled by axial displacement of the weft yarn gripper cone 130, so that the yarn storage drum which rotates at a high speed is of a simple construction as it requires no such came device and associated parts within the yarn storage drum as those in the weft yarn storage unit according to the first embodiment. The weft yarn gripper cone 130 may be arranged to be supplied with rotative power from the yarn storage drum 36 for rotation therewith.

Figure 16:
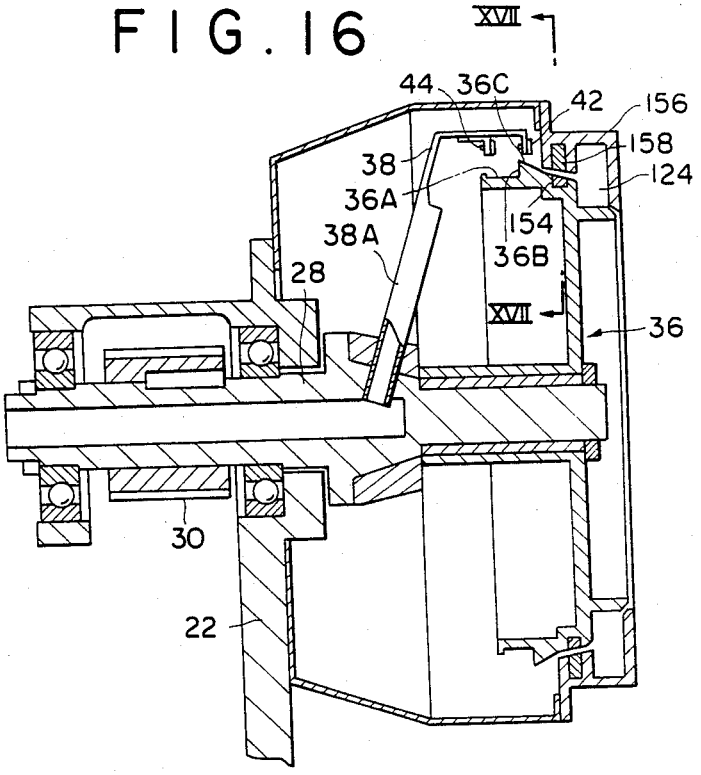
FIG. 16 is a cross-sectional view of a weft yarn storage unit according to an eighth embodiment.
Figure 17:
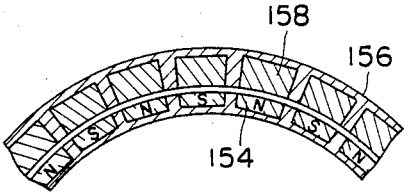
FIG. 17 is a cross-sectional view taken along line XVII—XVII of FIG. 16.

FIGS. 16 and 17 show a weft storage unit according to an eighth embodiment. The weft storage unit of FIG. 16 includes a yarn feeder arm 38 and a central shaft 28 which rotate in the same manner as with the first embodiment. The yarn storage drum 36 is rotatably supported on the central shaft 28 with no speed changer gear mechanism between the yarn storage drum 36 and the central shaft 28. A permanent magnet 154 is embedded in an outer periphery of the yarn storage drum 36, and an electromagnet 158 is embedded in a hood 156 fixed to the cover 77 in radially confronting relation to the permanent magnet 154, the hood 156 being of the same construction as that of the hood in the sixth embodiment. When the electromagnet 158 is energized, magnetic forces are generated between the electromagnet 158 and the permanent magnet 154, which jointly constitute a motor for driving the yarn storage drum 36 to rotate around the central shaft 28.

The hood 156 and the ayrn storage drum 36 define therebetween an air chamber 124 for controlling yarn withdrawal by a swirling stream of air supplied from an air blower (not shown). A small clearance is defined between the electromagnet 158 and the permanent magnet 154 for passage of the weft yarn therethrough.

An electric current to be supplied to the electromagnet 158 is adjusted such that the yarn storage drum 36 rotates at a circumferential speed higher than that of rotation of the yarn feeder arm 38 for high-speed ejection of the weft yarn and prevention of yarn breakage. Since the yarn storage drum according to the eighth embodiment is driven by the combination of the permanent magnet 154 and electromagnet 158, no train of gears is necessary which is required by the first embodiment, and hence the overall structure is simpler. The width of cloth to be woven can easily be changed since the rotational frequency of the yarn storage drum can be varied by changing the electric currect supplied to the electromagnet 158.

The above embodiments of the present invention are available in various combinations, and a variety of modifications may be made in the illustrated embodiments provided they have a differential yarn feeding device for maintaining the speed of rotation of the yarn storage drum at a desired speed and for winding the weft yarn around the yarn storage drum at the speed at which the weft yarn is drawn off the yarn supply package.

What is claimed is:

1. A weft yarn storage unit disposed between a yarn supply package and a weft insertion device for storing a weft yarn to be inserted in the warp shed, comprising a differential yarn feeding device for feeding the weft yarn from said yarn supply package, and a yarn storage means for winding the fed weft yarn therearound by co-operating with said differential yarn feeding device, storing the wound weft yarn therearound and unwinding the stored weft yarn therefrom by co-operating with said weft insertion device, said yarn storage means being continuously rotating in a direction opposite to the direction in which the weft yarn is unwound at a predetermined circumferential speed in response to an insertion speed of the weft yarn whereby the circumferential speed of the unwound point of the stored weft yarn unwound from said yarn storage means is reduced, so that the centrifugal force applied to the weft yarn and the ballooning are reduced, and the back tension of the weft yarn is reduced to a sufficient degree.

2. A weft yarn storage unit according to claim 1, wherein said differential yarn feeding device comprises a rotatable member continuously rotated at a predetermined circumferential speed in order to feed the weft yarn from said yarn supply package, and said yarn storage means comprises a rotatable member, having a portion for winding the fed weft yarn, continuously rotated at a predetermined circumferential speed in response to the insertion speed of the weft yarn, the fed weft yarn is wound and stored around said portion of said yarn storage means by the difference of circumferential speeds of movable members in said differential yarn feeding device and said yarn storage means.

3. A weft yarn storage unit according to claim 2, wherein said rotatable member of said yarn storage means comprises a yarn storage drum rotatable at a circumferential speed which is 45% or more of the insertion speed of the weft yarn.

4. A weft yarn storage unit according to claim 3, wherein said rotatable member of said differential yarn feeding device comprises a yarn feeder arm rotatable at a circumferential speed smaller than that of said yarn storage drum in the same direction as that of rotation thereof.

5. A weft yarn storage unit according to claim 4, wherein said yarn storage drum and said yarn feeder arm are driven through gear trains by one drive source.

6. A weft yarn storage unit according to claim 4, wherein said yarn storage drum is driven by one drive source, and said yarn feeder arm is driven by the other drive source.

7. A weft yarn storage unit according to claim 4, wherein said differential yarn feeding device comprises a length measuring device for measuring and feeding out a length of the yarn in synchronism with a rotation of a loom.

8. A weft yarn storage unit according to claim 1, wherein said differential yarn feeding device comprises a fluid yarn feeding device for forming an air swirl-flow having a circumferential speed higher than that of said storage means along a peripheral wall of said yarn storage means and for winding and storing the weft yarn along said peripheral wall of said yarn storage means.

9. A weft yarn storage unit according to claim 1, wherein said yarn storage means comprises a locking and releasing means for locking the stored weft yarn therearound until the weft yarn inserting and for releasing the locking condition of the weft yarn on the weft yarn inserting.

10. A weft yarn storage unit according to claim 6, wherein said one drive source comprises a motor comprising a permanent magnet means provided on outer peripheral wall of said yarn storage drum and an electromagnetic means provided on an inner wall of an annular hood opposed to said outer peripheral wall of said yarn storage drum and connected to an electrical source, thereby rotating said yarn storage means at the circumferential speed higher than that of said yarn feeder arm.

11. A weft yarn storage unit according to claim 3, wherein said yarn storage drum has a portion for winding and storing the fed weft yarn at an outer peripheral wall thereof.

12. A weft yarn storage unit according to claim 3, wherein said yarn storage drum has a portion for winding and storing the fed weft yarn at an inner wall thereof.

13. A weft yarn storage unit according to claim 2, wherein said rotatable member of said yarn storage means is positioned at near side of said insertion device.

14. A weft yarn storage unit according to claim 2, wherein said rotatable member of said differential yarn feeding device is positioned at near side of said insertion device.

15. A weft yarn storage unit according to claim 3, wherein said yarn storage drum has a conical portion.

16. A weft yarn storage unit according to claim 15, wherein said yarn storage drum has a parallel cylindrical portion.

17. A weft yarn storage unit according to claim 14, wherein wherein said rotatable member of said differential yarn feeding device comprises a disc member having a radial hole feeding the weft yarn.

18. A weft yarn storage unit according to claim 7, wherein said length measuring device comprises a roller means equipped at a tip portion of said yarn feeder arm and moved around a parallel cylindrical portion of said yarn storage drum by rotating in contact with said parallel cylindrical portion, thereby measuring the length of the weft yarn by rotating thereof on pressing the fed weft yarn around parallel cylindrical portion thereof.

19. A weft yarn storage unit according to claim 9, wherein said locking and releasing means comprises a cam rotatable in synchronous with the rotation of said loom, and a pin contacting said cam penetrating a peripheral wall of a yarn storage drum of said yarn storage means and changing the length thereof projecting from said peripheral wall in response to the rotation of said yarn storage drum.

20. A weft yarn storage unit according to claim 9, wherein said locking and releasing means comprises a yarn gripper cone opposed to said yarn storage means, a magnetic gripper means comprising permanent magnets respectively embedded in an outer peripheral wall of a yarn storage drum of said yarn storage means and an inner peripheral wall of said yarn gripper cone, and slide means for sliding said yarn gripper cone in the axial direction in synchronous with the rotation of said loom.

21. A weft yarn storage unit according to claim 9, wherein said locking and releasing means comprises air locking and releasing means comprising an air blower, annular chamber formed by a yarn storage drum of said yarn storage means, surrounding around said yarn storage drum and a hood opposed to said yarn storage drum, and a tangential passage connecting said air blower and said chamber, thereby controlling a withdrawal of weft yarn from said yarn storage drum by a swirling stream formed in said annular chamber.

* * * * *